US005293523A

United States Patent [19]

Posey

[11] Patent Number: 5,293,523

[45] Date of Patent: Mar. 8, 1994

[54] UNIDIRECTIONAL MAGNETIC PROXIMITY DETECTOR

[75] Inventor: William T. Posey, Chickasha, Okla.

[73] Assignee: Hermetic Switch, Inc., Chickasha, Okla.

[21] Appl. No.: 83,687

[22] Filed: Jun. 25, 1993

[51] Int. Cl.[5] ..... H01H 9/00

[52] U.S. Cl. ..... 335/205; 335/207; 335/151

[58] Field of Search ..... 335/205, 206, 207, 151, 335/152, 153

[56] References Cited

U.S. PATENT DOCUMENTS

| | | | |
|---|---|---|---|
| 3,993,885 | 11/1976 | Kominami et al. | 335/207 |
| 4,038,620 | 7/1977 | Shlesinger, Jr. et al. | 335/153 |
| 5,128,641 | 7/1992 | Posey | 335/151 |

OTHER PUBLICATIONS

Exhibit A-Hermetic Switch, Inc. invoice dated Mar. 26, 1993, for distribution of samples described and claimed in the present application.

Exhibit B-Hermetic Switch, Inc. price quotation, dated Apr. 22, 1993, for products described and claimed in the present application.

*Primary Examiner*—Lincoln Donovan

*Attorney, Agent, or Firm*—Craig W. Roddy

[57] ABSTRACT

Assembly for unidirectional magnetic proximity detecting wherein a magnet is used in conjunction with a permeable plate for absorbing magnetic flux and a reed type switch. The switch contacts remain open due to the absorption of the magnetic flux away from the contacts and into the permeable plate. Proximation of a permeable target object near the magnet enhances the magnetic flux creating an opposite magnetic flux across the switch contacts; thus, actuating the switch closed. Proximation of the permeable target object is only effective in actuating the switch when it approaches the sensing area defined adjacent to the magnet portion opposite the permeable plate. A preferred apparatus includes an enclosure which provides a weatherproof environment for the detector assembly.

25 Claims, 4 Drawing Sheets

UNIDIRECTIONAL MAGNETIC PROXIMITY DETECTOR

BACKGROUND

The present invention relates generally to a magnetically actuated detector which is responsive to proximation of a permeable object, and which is particularly useful in providing a magnetically actuated switch having unidirectional sensitivity to permeable objects.

Magnetic proximity switches employing reed switches or similar contact configurations for actuation in response to a magnetic field exist in the prior art. U.S. Pat. No. 5,128,641 provides a representative showing of a magnetic proximity switch wherein reed contacts are disposed in a neutral magnetic flux such that switch actuation occurs upon unbalancing the magnetic flux field. This type of magnetic proximity switch employs a plurality of magnets and places the reed switch axis in a magnetic field null position which is shifted or unbalanced by proximation of a permeable object to actuate the switch. This prior art magnetic switch does not have limited directional sensitivity, and therefore, cannot be mounted or located near a permeable material and remain actuatable with respect to proximation of a permeable target object.

Magnetic switches with reed type contacts that are actuatable in response to proximation of a permeable object, become permanently actuated when adjacently mounted to permeable material because the material creates a permanent change in the magnetic flux field. However, the embodiment of the present invention provides an apparatus which can be mounted on a permeable material and remain actuatable in response to a permeable target object.

Because magnetic proximity switches in the prior art are not unidirectional in sensitivity and are normally rendered inoperable when mounted on a permeable material there is a need for a simple, economical and effective unidirectional magnetic proximity detector; however, until now, no such apparatus has been developed.

SUMMARY

The embodiment of the invention is directed to an improved form of magnetic proximity detector, which uses a reed switch or similar contact switch for actuation in response to a magnetic field. A preferred version of the apparatus utilizes a single magnet and is unidirectional in sensitivity; thus, allowing for operation when the magnetic proximity detector is mounted on a permeable material.

When prior art magnetic proximity switches are mounted or placed next to a permeable material, the material causes an unbalancing of the magnetic flux field which results in actuation of the switch contacts. Therefore, the switch contacts remain closed while the magnetic flux field is affected. This undesirable change in the magnetic flux field, which renders the switch insensitive to the proximation of a permeable target object, is prevented with use of the present embodiment of the invention.

More specifically, a preferred embodiment of the invention comprises a reed switch having a pair of aligned reed contacts with an offset gap, a single magnet mounted on one of the reed contacts, and a permeable plate for absorbing magnetic flux from the magnet. The reed switch is mounted axially parallel to the permeable plate while the magnet is mounted on the portion of the reed contact located near the offset gap and away from the permeable plate.

The axis or direction of polarization of the magnet is perpendicular to the reed contacts. Wherein, the magnetic flux from the magnet pole located adjacent the reed contact is absorbed into the permeable plate rather than transferred into the reed contact on which it is mounted. Thus, the reed contacts are not receiving effective amounts of opposite magnetic flux which are necessary for actuating the switch closed.

When a permeable target object approaches the pole of the magnet located away from the permeable plate, the magnetic flux from the magnet is enhanced; thereby, creating an effective magnetic flux transfer into the reed contacts. The enhanced magnetic flux is transferred through the reed contact on which the magnet is mounted, and opposite magnetic flux is transferred to the other reed contact. This creates an opposite magnet polarity across the reed contacts causing the reed switch to close.

Critical sensitivity adjustments are made by: altering the magnet size, varying the mounting distance between the magnet and the offset gap, varying the mounting distance between the permeable plate and the reed switch, and varying the mounting distance between the reed contact and the magnet.

The detector assembly is preferably mounted in a body to ensure protection from the outside environment. All portions of the body except the unidirectional sensitivity area, which is the area located adjacent the magnet and away from the permeable plate, may be constructed of a permeable material such as steel. Wherefor, the permeable plate is omitted if the body is made of a sufficiently permeable material.

As such, it is a first object of the embodiment of the invention to provide a magnetic proximity detector assembly which is unidirectional in sensing the proximation of a permeable target object.

It is a further object of the embodiment of the invention to provide a magnetic proximity detector assembly which remains sensitive and actuatable when mounted on a permeable material.

It is a further object of the embodiment of the invention to provide a magnetic proximity detector assembly which remains operable when the permeable plate has greater permeability than necessary for magnetic saturation.

It is a further object of the embodiment of the invention to provide a magnetic proximity detector assembly which utilizes a single magnet for operation.

It is a further object of the embodiment of the invention to provide a magnetic proximity detector assembly which has a very thin overall construction.

It is a further object of the embodiment of the invention to provide a magnetic proximity detector assembly which allows possible miniaturization in construction.

It is a further object of the embodiment of the invention to provide a magnetic proximity detector assembly which can be enclosed in a permeable material such as steel, except in the unidirectional sensing area, for added strength in the enclosure construction.

It is a further object of the embodiment of the invention to provide a magnetic proximity detector assembly which can be enclosed in a permeable material such as steel, except in the unidirectional sensing area, allowing omission of the permeable plate.

It is a final object of the embodiment of the invention to provide a magnetic proximity detector assembly which can be used outside and is weatherproof.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1A:
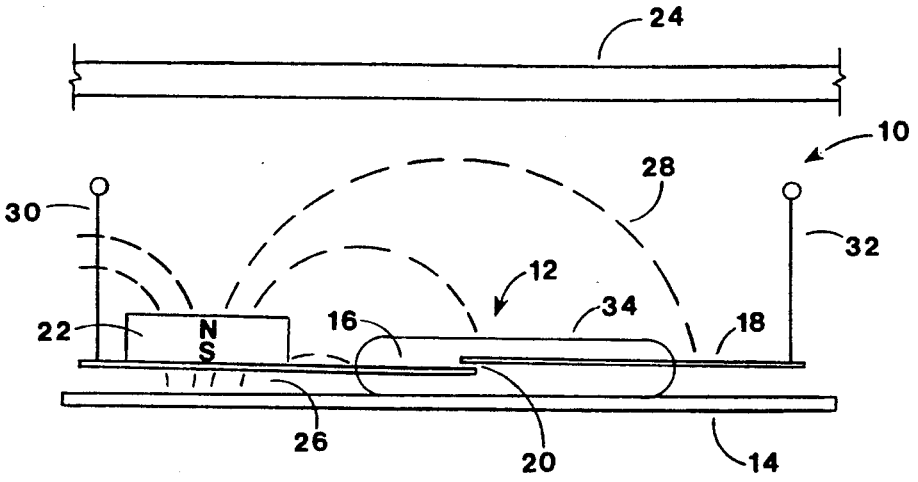
FIG. 1A is a schematic drawing of a unidirectional magnetic proximity detector assembly constructed in accordance with the present embodiment of the invention.
Figure 1B:
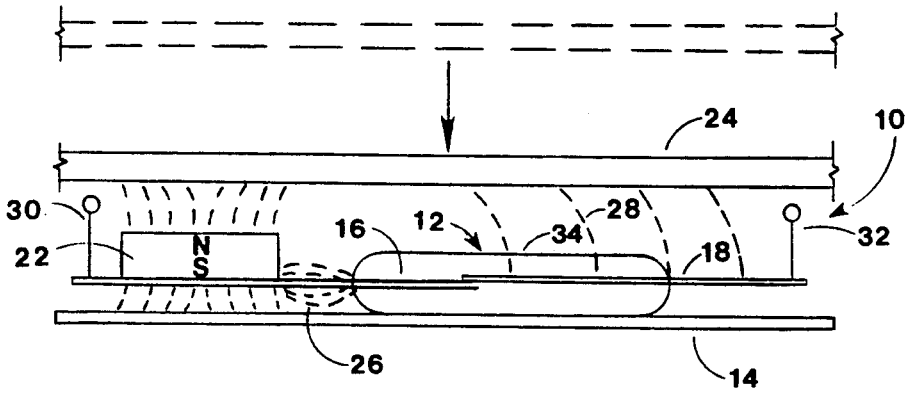
FIG. 1B is a schematic drawing of the detector assembly of FIG. 1A when actuated.

As best illustrated in FIGS. 1A and 1B, the present embodiment of the invention relates to a detector assembly 10 which is useful in operating as a unidirectional magnetic proximity detector. The detector assembly 10 remains unidirectionally actuatable when adjacently mounted to a permeable material. In FIGS. 1A and 1B, a preferred detector assembly 10 contains a reed switch 12 fixed axially parallel to a permeable plate 14. The reed switch 12 has a pair of aligned reed contacts 16, 18 which form an offset gap 20.

The detector assembly 10 is responsive to a magnetic flux field produced by a magnet 22. The magnet 22 is mounted on the reed contact 16 such that it is located near the offset gap 20 and along the reed contact 16 portion located away from the permeable plate 14.

The axis or direction of polarization of the magnet 22 is perpendicular to the axis of the reed contacts 16, 18. The north and south poles of the magnet 22 may be reversed without affecting the function of the detector assembly 10.

In FIG. 1A, the detector assembly 10 is shown as being potentially responsive to a permeable object 24 which, as shown, is not proximate to the detector assembly 10 and is out of the magnetic flux field. Thus, while the permeable object 24 is not proximate the detector assembly 10, magnetic flux 26 is absorbed into the permeable plate 14 wherein an effective amount of magnetic flux 26, sufficient for actuating the switch closed, is not transferred through the reed contact 16 to the offset gap 20.

FIG. 1B shows the effect on the magnetic flux field as the permeable object 24 is moved into proximate position. The permeable object 24 is of relatively high permeability such that its presence in the magnetic flux field enhances the magnetic flux 26, 28 from the magnet 22.

Magnetic flux from the magnet 22 is enhanced such that magnetic flux 26 is transferred through the reed contact 16 on which the magnet 22 is mounted, and opposite magnetic flux 28 is transferred to the other reed contact 18. Thus, an opposite magnetic polarity is produced across the reed contacts 16, 18.

The opposite magnetic polarity actuates the reed contacts 16, 18 causing them to close and to complete the circuits connected between switch output terminals 30, 32. Removal of the permeable object 24 from the proximate position allows the reed contacts 16, 18 to open, as in FIG. 1A.

Any type of reed switch may be used including Form A and Form C type switches. However, a preferred reed switch 12 may be formed in conventional manner with the reed contacts 16, 18 formed of ferromagnetic material such as No. 52 nickel-iron alloy, which is annealed to increase permeability, and copper strike contacts with rhodium plating applied to assure maximum electrical contact. The reed contacts 16, 18 are hermetically sealed within a tubular glass envelope 34 and external switch output terminals 30, 32 are connected to the respective reed contacts 16, 18.

The magnet 22 may be formed from any of a number of ferromagnetic materials but it is preferred to use a ceramic magnet such as magnet material that is referred to as barium ferrite ceramic. There is also a suitable barium ferrite magnet having a softer binder that is referred to as PLASTIFORM TM. The ceramic magnet is characterized by high ferromagnetic strength and easy polarization control as the magnet can be polarized variously across selected dimensions of the material.

The permeable plate 14 may be formed from an type of permeable material capable of sufficiently absorbing the magnetic flux 26 from the magnet 22. It is preferred to use a plate or strip of steel, having sufficient size to absorb all of the magnetic flux 26. Further, having a permeable plate 14 of sufficiently greater size than required for magnetic saturation is desirable for preventing sensitivity variations due to permeable materials located near the detector assembly 10.

The reed switch 12, permeable plate 14 and magnet 22 are affixed together with potting material such as formulated resins. The potting material allows the detector assembly 10 to have set sensitivity characteristics.

Figure 2:
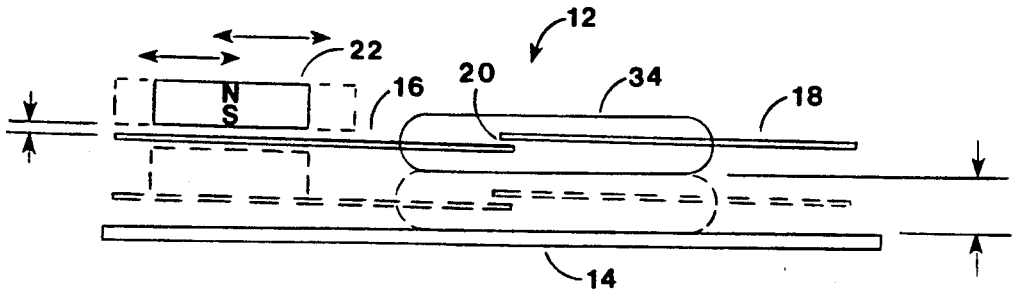
FIG. 2 is a schematic illustration showing the magnetic flux sensitivity adjustments between the switch and the permeable plate; the reed contact and the magnet; and the magnet along the reed contact.

FIG. 2 illustrates critical mounting adjustments which are used in varying the reed switch 12 sensitivity of the detector assembly 10 illustrated in FIGS. 1A and 1B. The reed switch 12 may be mounted directly on the permeable plate 14 or at varying distances therefrom. The magnet 22 may be mounted directly on the reed contact 16 or at varying distances therefrom. Also, the magnet 22 may be mounted at varying positions along the reed contact 16.

Figure 3A:
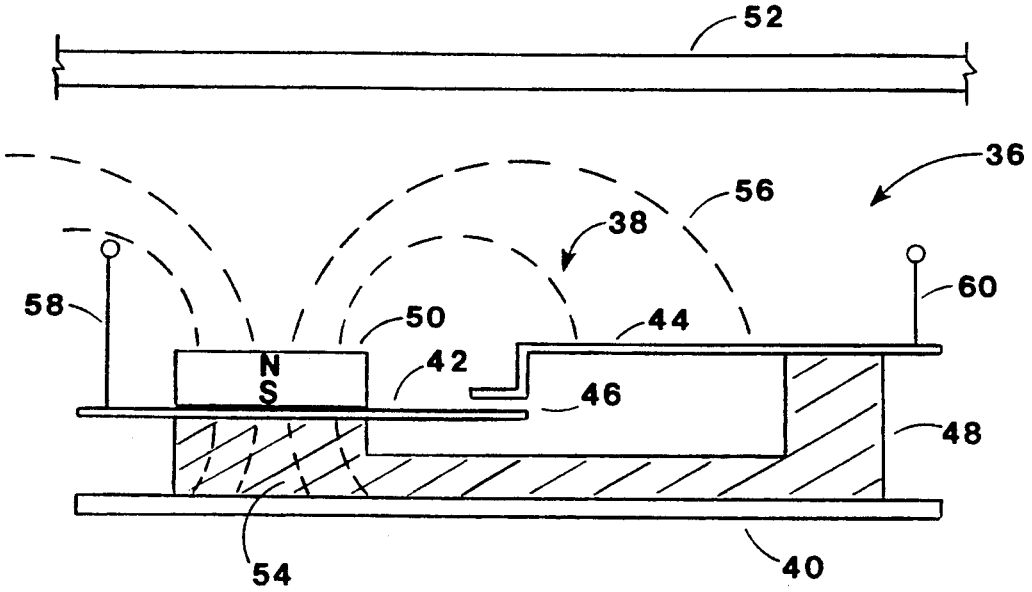
FIG. 3A is a schematic illustration showing an alternative embodiment of the unidirectional magnetic proximity detector assembly having an open relay contact switch.

FIG. 3A illustrates another form of detector assembly 36 which utilizes an open relay contact switch 38 rather than the reed type switch 12 of FIGS. 1A and 1B. The open relay contact switch 38 is fixed axially parallel to a permeable plate 40. The open relay contact switch 38 has a pair of aligned relay contacts 42, 44 which form an offset gap 46. The relay contacts 42, 44 are affixed to an insulator material 48, such as phenolic materials, positioned between the relay contacts 42, 44 and the permeable plate 40.

The detector assembly 36 is responsive to a magnetic flux field produced by a magnet 50. The magnet 50 is mounted on the relay contact 42 near the offset gap 46 and on the relay contact 42 portion located away from the permeable plate 40.

In FIG. 3A, the detector assembly 36 is shown as being potentially responsive to a permeable object 52 which, as shown, is not proximate to the detector assembly 36 and is out of the magnetic flux field. Thus, while the permeable object 52 is not proximate the detector assembly 36, magnetic flux 54 is absorbed into the permeable plate 40 wherein an effective amount of opposite magnetic flux, sufficient for actuating the switch closed, is not present across the reed contacts.

Figure 3B:
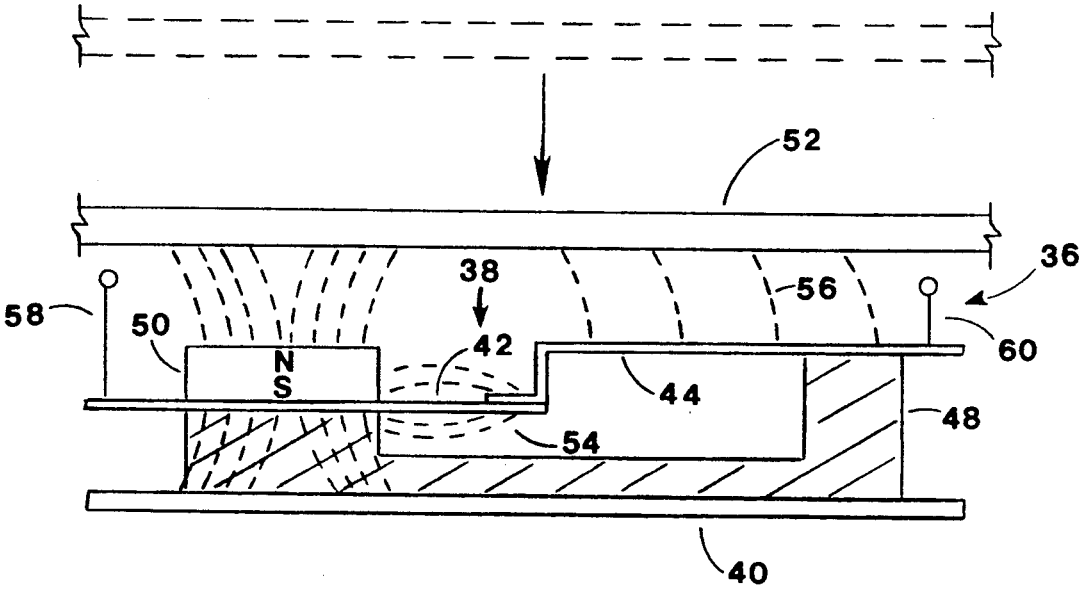
FIG. 3B is a schematic drawing of the detector assembly of FIG. 3A when actuated.

FIG. 3B shows the effect on the magnetic flux field as the permeable object 52 is moved into proximate position. The permeable object 52 is of relatively high permeability such that its presence in the magnetic flux field enhances the magnetic flux 54 from the magnet 50; thereby, creating an opposite magnetic polarity across the relay contacts 42, 44.

Magnetic flux 54, 56 from the magnet 50 is enhanced such that magnetic flux 54 is transferred through the relay contact 42 on which the magnet 50 is mounted, and opposite magnetic flux 56 is transferred to the other relay contact 44.

Opposite magnetic polarity across the relay contacts 42, 44 causes them to close and to complete the circuits connected between switch output terminals 58, 60. Removal of the permeable object 52 from the proximate position allows the relay contacts 42, 44 to open, as in FIG. 3A.

Figure 4A:
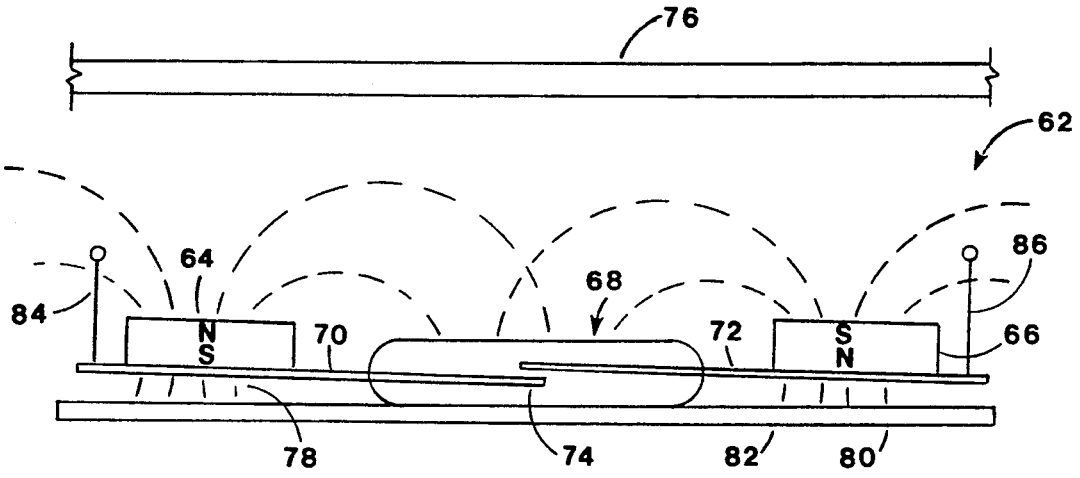
FIG. 4A is a schematic drawing of an alternative embodiment of the unidirectional magnetic proximity detector assembly having two magnets and a center gap contact switch.
Figure 4B:
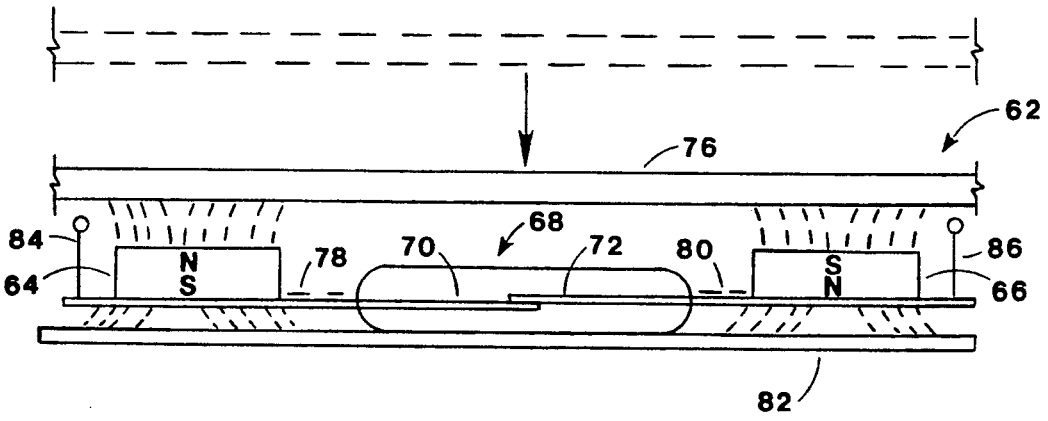
FIG. 4B is a schematic drawing of the detector assembly of FIG. 4A when actuated.

FIGS. 4A and 4B illustrate yet another form of detector assembly 62 that utilizes a first magnet 64, a second magnet 66 and a reed type switch 68 having a pair of aligned reed contacts 70, 72 with a center gap 74. In FIG. 4A, the detector assembly 62 is shown as being potentially responsive to a permeable object 76 which, as shown, is not proximate to the detector assembly 62 and is out of the magnetic flux field. Thus, while the permeable object 76 is not proximate the detector assembly 62, magnetic flux 78, 80 from the first and second magnets 64, 66, respectively, is absorbed into a permeable plate 82 wherein an effective amount of opposite magnetic flux 78, 80, sufficient for actuating the switch 68 closed, is not present across the reed contacts 70, 72.

The first and second magnets 64, 66 each have oppositely polarized poles. The axis or direction of polarization of the first and second magnets 64, 66 is perpendicular to the axis of the reed contacts 70, 72. In addition, the magnets 64, 66 are oppositely mounted, with respect to polarity, on the reed contacts 70, 72. Wherefor, the reed contacts 70, 72 each have an opposite magnetic flux transferred therethrouqh when the magnets 64, 66 are enhanced by proximation of a permeable object 76.

FIG. 4B shows the effect on the magnetic flux field as the permeable object 76 is moved into proximate position. The permeable object 76 is of relatively high permeability such that its presence in the magnetic flux field enhances the magnetic flux from the first and second magnets 64, 66; thereby, creating an opposite magnetic polarity across the reed contacts 70, 72. Magnetic flux 78 from the first magnet 64 is enhanced and is transferred through the reed contact 70 on which the first magnet 64 is mounted, and magnetic flux 80 from the second magnet 64 is enhanced and is transferred through the reed contact 72 on which the second magnet 66 is mounted.

The opposite magnetic polarity across the reed contacts 70, 72 causes them to close and to complete the circuits connected between switch output terminals 84, 86. Removal of the permeable object 76 from the proximate position allows the reed contacts 70, 72 to open, as in FIG. 4A.

Figure 5:
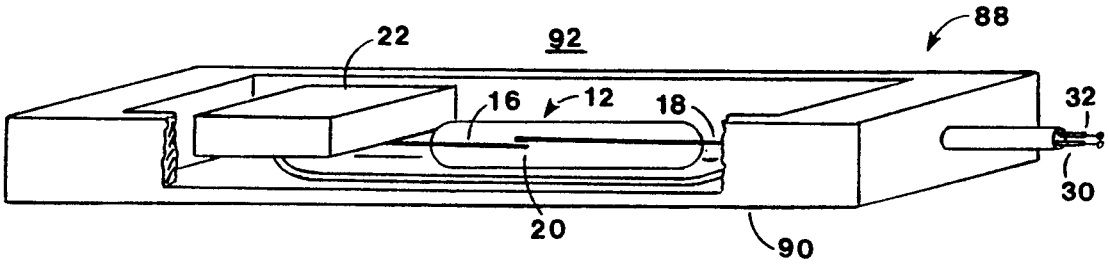
FIG. 5 is a perspective view of the unidirectional magnetic proximity detector apparatus with the detector assembly parts shown in cutaway of the permeable body; not included in the illustration is the potting compound used for covering the detector assembly and for completing enclosure of the body.
Figure 6:
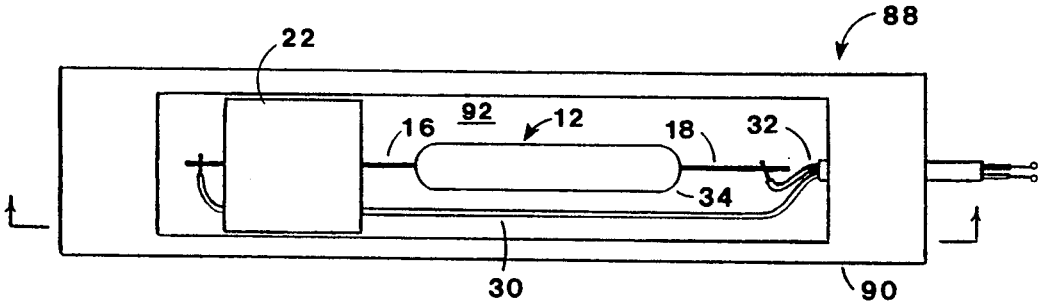
FIG. 6 is a top plan view of FIG. 5.
Figure 7:
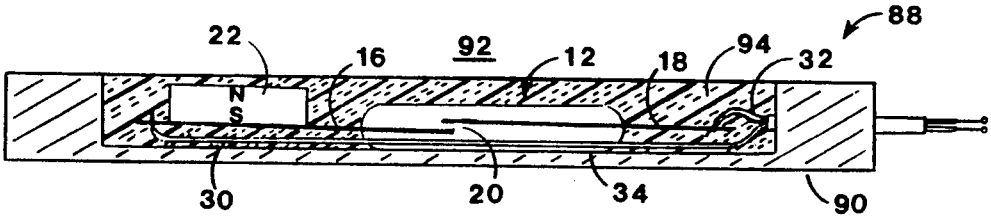
FIG. 7 is a sectioned partial side elevation view along line 7—7 of FIG. 6, included in the illustration is the potting compound used for enclosing the body and securing the detector assembly therein.

FIGS. 5, 6 and 7 illustrate an apparatus 88 utilizing the detector assembly 10 of FIG. 1A, although the detector assemblies 36, 62 shown in FIGS. 3A and 4A may be used in a similar manner. The apparatus 88 includes a body 90 which is made of either permeable or non-permeable materials; however, for illustration, FIGS. 5, 6 and 7 are shown using a permeable body 90.

The permeable body 90 is made from steel or other similar materials for protection from the environmental surrounds. However, the area 92 of the permeable body 90 which is to be proximated by a permeable object is not constructed of permeable material, but is filled with a potting compound such as formulated resins. The potting compound 94 encloses the detector assembly within the permeable body 90 and is illustrated in FIG. 7.

If the permeable body 90, shown in FIGS. 5, 6 and 7, is sufficient for absorbing the magnetic flux normally absorbed by the permeable plate 30 of FIG. 1A, the permeable plate 30 is omitted from the detector assembly 88. Likewise, as shown in FIG. 2, if the permeable plate is omitted, critical sensitivity adjustments for the reed switch 12 characteristics are made by varying the mounting distance between the reed switch 12 and the permeable body 90, as well as, using other sensitivity adjustments previously described and illustrated in FIG. 2.

Although the apparatus in FIGS. 5, 6 and 7 illustrates using a permeable body 90 and omitting the permeable plate 30, as shown in FIG. 1A, a molding compound such as formulated resins may be used to construct the body 90 to enclose the detector assemblies 10, 36 and 62 as shown in FIGS. 1A, 3A and 4A. If the molded body is used, then the permeable plate 30, as shown in FIG. 1A, is included. A potting compound is preferably used to affix the detector assembly 10, 36 and 62 parts within the molded body.

The previously described versions of the invention disclose a novel form of detector assembly that functions in response to changes in the magnetic flux field and is particularly adaptable for unidirectional proximity sensing. The apparatus is mountable on permeable materials while remaining operable in the limited direction of sensitivity. A preferred type of assembly uses a single magnet and is capable of very thin construction and miniaturization. In addition, the assembly can be enclosed in a weatherproof body which may include construction with permeable materials.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A magnetic detector actuatable by unidirectional proximation of a permeable object, comprising:

a magnet means for producing a magnetic flux, said magnet means having a first end and a second end, said magnet means being oppositely polarized transversely through the first and second ends;

a magnetic switch means for opening and closing a circuit connected between switch output terminals, said magnetic switch means having first and second aligned contacts, wherein the first end of said magnet means is located adjacent the first aligned contact; and an absorbing means for absorbing the magnetic flux from the first end of said magnet means, wherein an opposite magnetic flux is not produced across the first and second aligned contacts and said magnetic switch means is open;

wherein the unidirectional proximation of the permeable object to the second end of said magnet means enhances the magnetic flux from the first end of said magnet means through the first aligned contact, and enhances the magnetic flux from the second end of said magnet means to the second aligned contact; thus, producing an opposite magnetic polarity across the first and second aligned contacts to actuate the switch means closed.

2. A detector as recited in claim 1, wherein:

said magnet means is a single magnet formed from ceramic magnet material.

3. A detector as recited in claim 1, wherein:

said magnetic switch means is a magnetic reed switch.

4. A detector as recited in claim 3, wherein: said magnetic reed switch comprises:

a hermetically sealed, elongated enclosure having first and second ends and an axial chamber; the first aligned contact being made of permeable conductive material and secured through the first end along the chamber; and the second aligned contact being made of permeable conductive material and secured through the second end along the chamber.

5. A detector as recited in claim 1, wherein:

the first and second aligned contacts form an offset gap positioned towards said magnet means.

6. A detector as recited in claim 1, wherein:

said absorbing means is a plate or strip of permeable material suitable for absorbing magnetic flux from said magnet means.

7. A detector as recited in claim 6, wherein:

the permeable material for absorbing the magnetic flux is steel.

8. A detector as recited in claim 1, wherein:

said magnetic switch means is an open relay contact.

9. A detector as recited in claim 1, wherein:

said absorbing means is a permeable body for partially enclosing the magnetic detector and for absorbing the magnetic flux, said permeable body sufficiently encloses the magnetic detector to absorb the magnetic flux from the first end of said magnet means; said permeable body does not enclose the area adjacent the second end of said magnet means so that proximation of the permeable object can enhance the magnetic flux from said magnet means to the first and second aligned contacts.

10. A detector as recited in claim 9, wherein the permeable body is filled with a potting compound to provide an enclosure for the detector assembly.

11. A detector as recited in claim 1, further comprising:

an enclosing means for enclosing the magnetic detector, said enclosing means forms a switch body to extend external connecting leads which are attached to said magnetic switch means.

12. A detector as recited in claim 11, wherein:

said enclosing means is made from a non-permeable material.

13. A magnetic detector actuatable by proximity of a permeable object, comprising:

a first magnet means for producing a magnetic flux, said magnet means having a first end and a second end, said magnet means being oppositely polarized transversely through the first and second ends;

a second magnet means for producing a magnetic flux, said magnet means having a first end and a second end, said magnet means being oppositely polarized transversely through the first and second ends;

a magnetic switch means for opening and closing a circuit connected between switch output terminals, said magnetic switch means having first and second aligned contacts, wherein the first end of said first magnet means is located adjacent the first aligned contact and the first end of said second magnet means is located adjacent the second aligned contact; the first end of said first magnet means having an opposite polarity from the first end of said second magnet means; and an absorbing means for absorbing the magnetic flux from the first end of said first and second magnet means, wherein an opposite magnetic flux is not produced across the first and second aligned contacts and said magnetic switch means is open;

wherein the unidirectional proximation of the permeable object to the second end of said first and second magnet means enhances the magnetic flux from the first end of said first and second magnet means through the first and second aligned contacts, respectively; thus, producing an opposite magnetic polarity across the first and second aligned contacts to actuate the switch means closed.

14. A detector as recited in claim 13, wherein:

said first and second magnet means are each a single magnet formed from ceramic magnet material.

15. A detector as recited in claim 13, wherein:

said magnetic switch means is a magnetic reed switch.

16. A detector as recited in claim 15, wherein: said magnetic reed switch comprises:

a hermetically sealed, elongated enclosure having first and second ends and an axial chamber; the first aligned contact being made of permeable conductive material and secured through the first end along the chamber; and the second aligned contact being made of permeable conductive material and secured through the second end along the chamber.

17. A detector as recited in claim 13, wherein:

the first and second aligned contacts form a center gap centrally located between said first and second magnet means.

18. A detector as recited in claim 13, wherein:

said absorbing means is a plate or strip of permeable material suitable for absorbing magnetic flux from said first and second magnet means.

19. A detector as recited in claim 18, wherein:

the permeable material for absorbing the magnetic flux is steel.

20. A detector as recited in claim 13, wherein:

said magnetic switch means is an open relay contact.

21. A detector as recited in claim 13, wherein:

said absorbing means is a permeable body for partially enclosing the magnetic detector and for absorbing the magnetic flux, said permeable body sufficiently encloses the magnetic detector to absorb the magnetic flux from the first end of said magnet means; said permeable body does not enclose the area adjacent the second end of said magnet means so that proximation of the permeable object can enhance the magnetic flux from the magnet means to the first and second aligned contacts.

22. A detector as recited in claim 21, wherein the permeable body is filled with a potting compound to provide an enclosure for the detector assembly.

23. A detector as recited in claim 13, further comprising:

an enclosing means for enclosing the magnetic detector, said enclosing means forms a switch body to extend external connecting leads which are attached to said magnetic switch means.

24. A detector as recited in claim 23, wherein:

said enclosing means is made of a non-permeable material.

25. A magnetic detector actuatable by proximity of a permeable object, comprising:

a magnet for producing a magnetic flux, said magnet having a first end and a second end, said magnet is oppositely polarized transversely through the first and second ends;

an enclosed magnetic reed switch having a hermetically sealed, elongated enclosure having first and second ends and an axial chamber, a first reed contact of permeable conductive material secured through the first end along the chamber and aligned with a second reed contact of permeable conductive material secured through the second end along the chamber; wherein the first end of said magnet is located adjacent the first reed contact;

a permeable plate for absorbing the magnetic flux from the first end of said magnet, wherein an effective amount of opposite magnetic flux is not produced across the first and second reed contacts; thus, preventing closure of the enclosed magnetic reed switch; and an enclosing means for enclosing the magnetic detector to form a switch body extending external connecting leads which are attached to the first and second reed contacts;

wherein the permeable object proximation to the second end of said magnet enhances the magnetic flux from the first end of said magnet through the first reed contact, and from the second end of said magnet to the second reed contact; thus, producing an opposite magnetic polarity across the first and second contacts to actuate the magnetic reed switch closed.

* * * * *